US010459465B2

(12) United States Patent
Jezik et al.

(10) Patent No.: US 10,459,465 B2
(45) Date of Patent: Oct. 29, 2019

(54) POWER-DOWN DISCHARGER

(71) Applicant: SEMICONDUCTOR COMPONENTS INDUSTRIES, LLC, Phoenix, AZ (US)

(72) Inventors: Jan Jezik, Bystricka (CZ); Pierre Andre Genest, Lafitte-Vigordane (FR)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 14/844,927

(22) Filed: Sep. 3, 2015

(65) Prior Publication Data

US 2017/0017249 A1 Jan. 19, 2017

Related U.S. Application Data

(60) Provisional application No. 62/193,221, filed on Jul. 16, 2015.

(51) Int. Cl.
*G05F 1/46* (2006.01)

(52) U.S. Cl.
CPC ..... *G05F 1/468* (2013.01)

(58) Field of Classification Search
CPC ..... H02M 3/156; G05F 1/56; G05F 1/565; G05F 1/573; G05F 1/575
See application file for complete search history.

(56) References Cited

U.S. PATENT DOCUMENTS 5,831,302 A * 11/1998 McIntyre ..... G11C 5/147 323/313
9,106,228 B2 8/2015 Genest
2011/0006746 A1* 1/2011 Lu ..... H02M 1/36 323/288
2012/0286752 A1* 11/2012 Tsukiji ..... H02M 3/156 323/282
2013/0043949 A1 2/2013 Genest
2014/0203791 A1* 7/2014 Lee ..... G05F 1/468 323/282
2014/0217999 A1* 8/2014 Wibben ..... H02M 1/36 323/282
2014/0233285 A1* 8/2014 Nishijima ..... H02M 7/217 363/62

* cited by examiner

*Primary Examiner* — Nguyen Tran
*Assistant Examiner* — Monica Mata
(74) *Attorney, Agent, or Firm* — Ramey & Schwaller, LLP; Daniel J. Krueger

(57) ABSTRACT

Active post-power loss discharging of capacitors is provided. In an integrated circuit having a startup behavior depending on a capacitor voltage, a discharge transistor is provided to discharge the capacitor. A power-down discharger actively drives the discharge transistor after a power supply voltage drops below a threshold. The power-down discharger may include, or be coupled to, an internal capacitance that is charged when the power supply voltage is above the threshold, thereby storing sufficient energy for later driving of the discharge transistor. A diode is employed to ensure that the loss of power does not drain away the needed energy until after the discharge has been completed. One illustrative discharging method includes: sensing a condition indicative of power supply voltage loss for an integrated circuit; and actively driving the discharge transistor into a conducting state. The sensing may include driving the discharge transistor inversely to a signal from a pin.

5 Claims, 4 Drawing Sheets

POWER-DOWN DISCHARGER

CROSS-REFERENCE TO RELATED APPLICATIONS

The present application claims priority to Provisional U.S. App. 62/193,221, filed 2015 Jul. 16 and titled "Power-down discharger" by inventors Jan Jezik and Pierre Andre Genest, which application is hereby incorporated herein by reference.

BACKGROUND

Power switches and voltage regulators are just two examples of integrated circuits that employ capacitors as a key part of their operation. Depending on how their operation ceases, such capacitors may be left with a residual charge that bleeds off very slowly. Circuits that presume that such capacitors are fully discharged for subsequent operations may exhibit undesired behavior when power is restored after an unexpected interruption. As an example, low drop-out regulators (LDOs) often rely on charging of an external capacitor for slowly ramping up the output voltage ("soft-start"). When the external capacitor is left with a residual charge, proper ramping is inhibited and may result in impermissible inrush current levels.

One approach to this problem relies on depletion-mode MOSFETs (metal-oxide-semiconductor field-effect transistors) whose conduction is inhibited when power is applied to the source. A loss of power returns the MOSFET to a conductive state, enabling it to discharge internal capacitances. However, at least some of the preferred semiconductor process flows do not provide for inclusion of depletion-mode MOSFETs.

SUMMARY

Accordingly, there is disclosed herein various active techniques for post-power loss discharging of capacitances (including discrete capacitors and MOSFET gates). One illustrative integrated circuit embodiment has a startup behavior that depends at least in part on a voltage of an internal or external capacitor. It includes a discharge transistor that discharges the capacitor when driven to a conducting state; and a power-down discharger that actively drives the discharge transistor to the conducting state after a power supply voltage provided to the integrated circuit drops below a threshold. The power-down discharger may include, or be coupled to, an internal capacitance that is charged when the power supply voltage is above the threshold, thereby storing sufficient energy for driving the discharge transistor after the power supply voltage drops below the threshold. A diode is employed to ensure that the loss of power does not drain away the needed energy until after the discharge has been completed.

One illustrative discharging method embodiment includes: sensing a condition indicative of power supply voltage loss for an integrated circuit; and actively driving a discharge transistor into a conducting state to discharge a capacitor used by the integrated circuit to provide a desired startup behavior. The sensing may include: receiving, with a shared gate of a complementary transistor pair, a signal from a power supply pin; and driving a gate of the discharge transistor inversely to said signal. Alternatively, the signal may be derived from an enable pin.

It should be understood that the drawings and corresponding detailed description do not limit the disclosure, but on the contrary, they provide the foundation for understanding all modifications, equivalents, and alternatives falling within the scope of the appended claims.

DETAILED DESCRIPTION

Figure 1B:
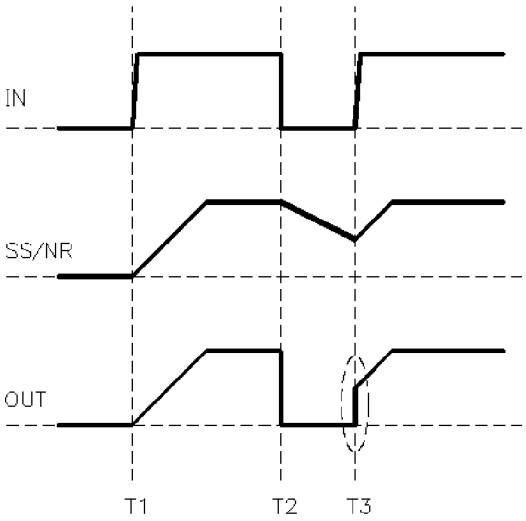
FIG. 1B shows signals associated with the LDO of FIG. 1A.
Figure 1A:
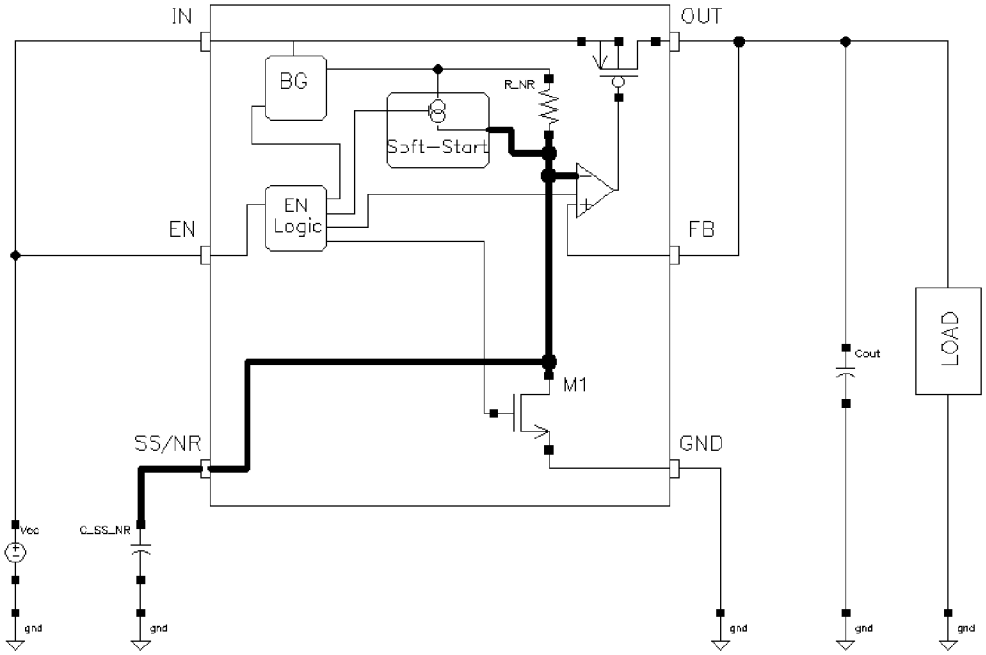
FIG. 1A shows an illustrative LDO embodiment.

FIG. 1A shows a first illustrative LDO embodiment. An input pin (IN) of the chip provides an unregulated, direct-current (DC), supply voltage (Vcc) to the source of a power FET (field-effect transistor). The chip's output pin (OUT) provides a regulated DC voltage from a power FET to an output capacitor (Cout), which drives a load circuit (LOAD). In the illustrated embodiment, the power FET is a p-channel MOSFET (PMOS), though an n-channel MOSFET (NMOS) could alternatively be used.

A feedback pin (FB) couples the output capacitor voltage to the noninverting input terminal of an operational amplifier ("op amp") whose output terminal drives the gate of the power FET. The inverting input terminal of the op amp is coupled via a soft-start/noise-reduction (SS/NR) pin to an external capacitor (C_SS_NR) to receive a reference voltage that ramps from zero to a desired value. A bandgap reference (BG) charges the external capacitor via a soft-start current source. A noise-reduction resistance (R_NR) may be provided in parallel with the soft-start current source to reduce the RC time constant and thereby filter out high-frequency noise.

The illustrative LDO embodiment further includes a powered-discharge FET (M1) to discharge the external capacitor as needed, e.g., when the LDO is disabled. The illustrated powered-discharge FET is an enhancement-mode NMOS. Its operation, along with the operation of the bandgap reference, the soft-start current source, and the op amp, is coordinated by an enable logic (EN logic) circuit in response to assertion of the signal to the enable pin (EN). When the enable signal is de-asserted, the op-amp drives the power FET to a nonconducting state, the bandgap reference is disabled, and the powered-discharge FET M1 is driven to a conducting state to discharge the external capacitor C_SS_NR.

As the enable signal becomes asserted, the powered-discharge FET is disabled while the bandgap reference and current source are enabled to charge the external capacitor to the desired reference voltage. Once the capacitor voltage reaches the nominal reference voltage, the soft-start current source may again be disabled, causing the external capacitor in combination with the noise-reduction resistance to function as a noise reduction filter.

FIG. 1B shows the SS/NR pin voltage and the output voltage that result from applying power (and thus asserting the enable signal EN) at time T1. The external capacitor ramps linearly to the desired reference voltage, producing a voltage on the output pin OUT that is similarly ramped linearly to the desired output voltage and regulated there. (The customer can select the slope of the ramp by varying the external capacitor.)

FIG. 1B further shows that while the output pin voltage drops quickly to zero at time T2 (when the supply power is lost), the SS/NR pin voltage experiences a slow decay. Powered-discharge FET M1 does not operate properly in the absence of power. As a consequence, there is a residual voltage on the external capacitor when power is restored at time T3. Rather than ramping from zero, the output pin voltage exhibits a rapid jump at time T3, producing an impermissible inrush current.

In other words, the illustrated LDO embodiment has a problem when the power supply is removed while the LDO is enabled. De-assertion of the enablement signal normally pushes the gate of M1 high to discharge the capacitor, but in the absence of power, the enable logic is unable to do so. The circuitry handling the external capacitor's discharge does not work and the capacitor stays charged for a period of time. When the power supply is connected again the soft-start charging process does not start with 0 V on the external capacitor, but from some residual voltage from previous operation. This behavior results in rapid voltage step-up LDO output, which introduces enormous inrush current because the LDO is trying to quickly charge the output capacitor. This behavior is undesirable.

Figure 2B:
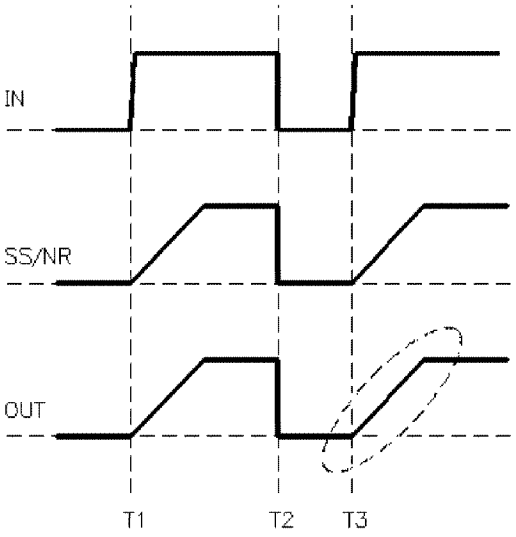
FIG. 2B shows signals associated with the LDO of FIG. 2A.
Figure 2A:
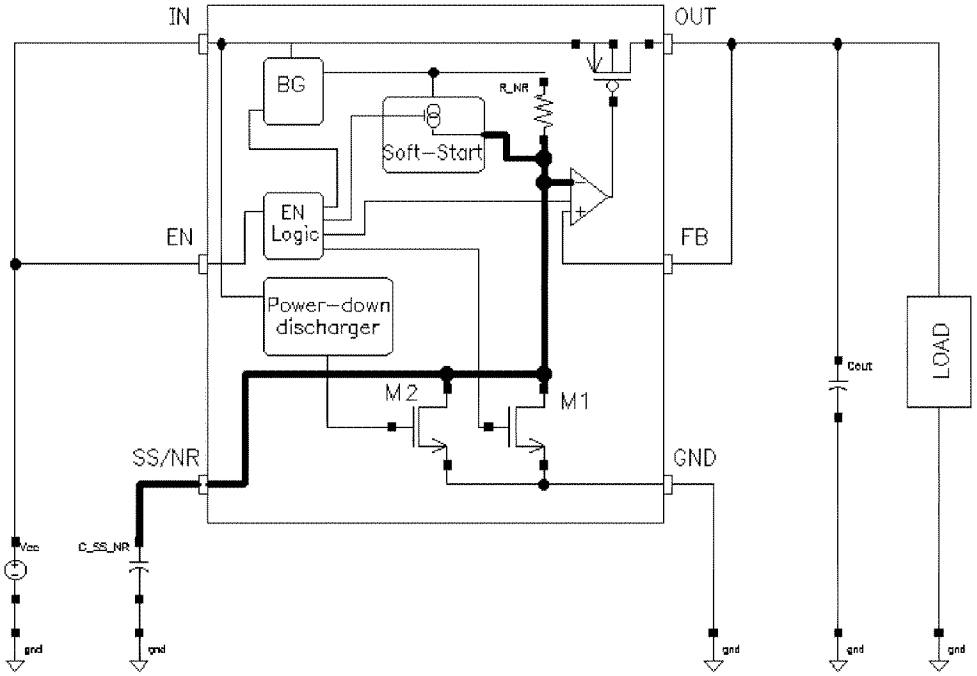
FIG. 2A shows an illustrative LDO equipped with a power-down discharger.

Accordingly, FIG. 2A shows an illustrative LDO having a power-down discharger that is able to operate without power supply. The power-down discharger stores sufficient energy to push and hold the gate voltage of a discharge transistor up for a time sufficient to discharge the external capacitor after the supply voltage is lost. (Loss, or de-assertion, of the power supply voltage occurs when the voltage falls below the threshold required for the proper operation of the integrated circuit. This threshold is typically around 1.4 to 2.5 V, but the actual value depends on the process and circuit design.) The embodiment illustrated in FIG. 2A includes a second discharge FET M2 that operates to discharge the external capacitor when its gate is asserted. A power-down discharger circuit is coupled between the input pin (IN) and the gate of M2 to pull-up and temporarily maintain the gate voltage after a power supply failure. The power-down discharger circuit further operates to de-assert the gate voltage when power is restored, thereby disabling the discharge transistor M2. With the assurance that the external capacitor is fully discharged, the LDO can restart properly upon power supply recovery.

To illustrate the resulting operation, FIG. 2B shows signals associated with the LDO of FIG. 2A, for comparison with the signals of FIG. 1B. As before, the initial application of supply power to the input pin IN at time T1 causes the SS/NR pin voltage to ramp linearly to the desired reference voltage and the output pin voltage to similarly ramp to the desired output voltage. Loss of supply power at time T2 causes the discharge FET M2 to actively discharge the SS/NR capacitor, so that when supply power is restored a short time later, M2 can return to a nonconducting state and enable the SS/NR pin voltage to again ramp linearly from zero, producing the desired output voltage ramp without excessive inrush current.

Figure 2C:
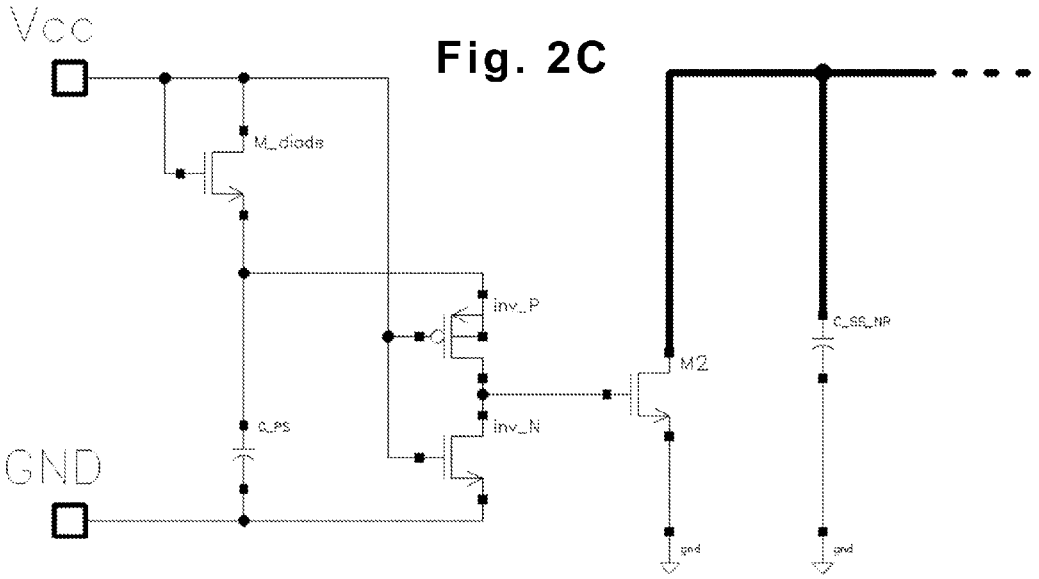
FIG. 2C shows an illustrative power-down discharger circuit

FIG. 2C shows an illustrative implementation of the power-down discharger circuit. The discharger circuit's discharge terminal is coupled to the gate of discharge FET M2 so as to assert the gate signal and thereby discharge the external capacitor C_SS_NR when supply power Vcc is lost. Two complementary MOSFETs (inv_P and inv_N) are configured as an inverter to hold the discharge terminal (and gate voltage of M2) low when supply power Vcc is asserted. The gates of the complementary MOSFETs are shared and jointly coupled to the supply power pin. Assertion of the supply power pin causes the inverter to de-assert the discharge terminal, rendering the discharge transistor M2 non-conducting.

Conversely, when the supply power pin is de-asserted (e.g., due to loss of power) the inverter asserts the discharge terminal, enabling the discharge transistor to conduct and thereby discharge the external capacitor. Assertion of the discharge terminal is powered by a power storage capacitor (C_PS), which gets charged via a diode (or a FET configured as a diode) M_diode from the power supply pin Vcc while supply power is available during normal operation. The diode M_diode also keeps the power storage capacitor from discharging via the power supply pin, ensuring that the power is delivered to the discharge terminal via the PMOS transistor inv_P when supply power is lost.

In the illustrated LDO embodiment of FIG. 2A, the output capacitor is expected to discharge through the load circuit. But any other capacitors that, like the external capacitor, might be left with an undesirable residual voltage can be similarly equipped with a discharge FET coupled to a power-down discharger. With a sufficient power storage capacitance, one power-down discharger may be used to drive multiple such discharge FETs.

Figure 3:
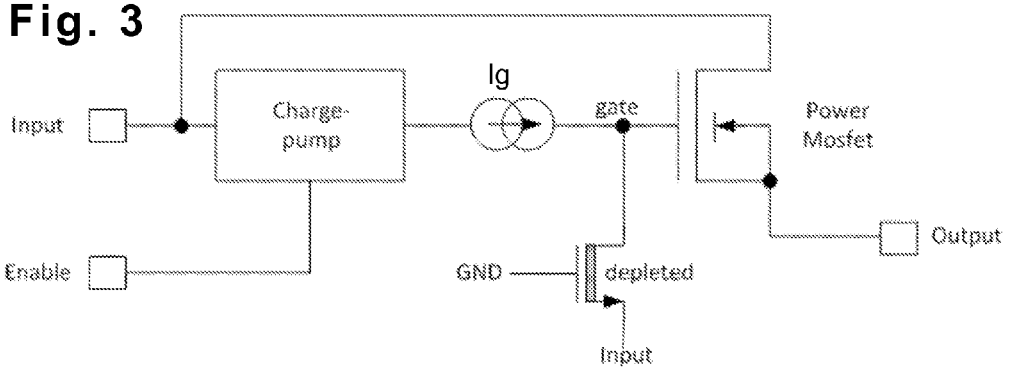
FIG. 3 shows an illustrative integrated power switch embodiment.

Power-down discharging may also be needed for the gates of power MOSFETs. For example, FIG. 3 shows an integrated power switch. An n-channel power MOSFET provides a drain-source connection between an input voltage pin (input) and an output voltage pin (output) when the gate is asserted. A charge pump, when enabled by assertion of the enable pin (enable), amplifies the input voltage to a suitable driving voltage for the power MOSFET. A current source (Ig) buffers the amplified voltage as it couples the charge pump to the gate of the power MOSFET.

Due to a parasitic capacitance, the gate of the power MOSFET could be left with a residual charge after an unexpected power loss, leaving the power switch in an undesired state. To prevent this, the power switch of FIG. 3 employs an n-channel depletion-mode MOSFET having a gate coupled to ground, a drain coupled to the gate of the power MOSFET, and a source coupled to the input voltage pin. With the input voltage asserted, the gate-to-source voltage is negative, inhibiting conduction and enabling the power MOSFET to operate normally. With the loss of the input voltage, the gate-to-source voltage approaches zero, enabling the depletion mode MOSFET to conduct and thereby discharge the gate of the power MOSFET.

Figure 4:
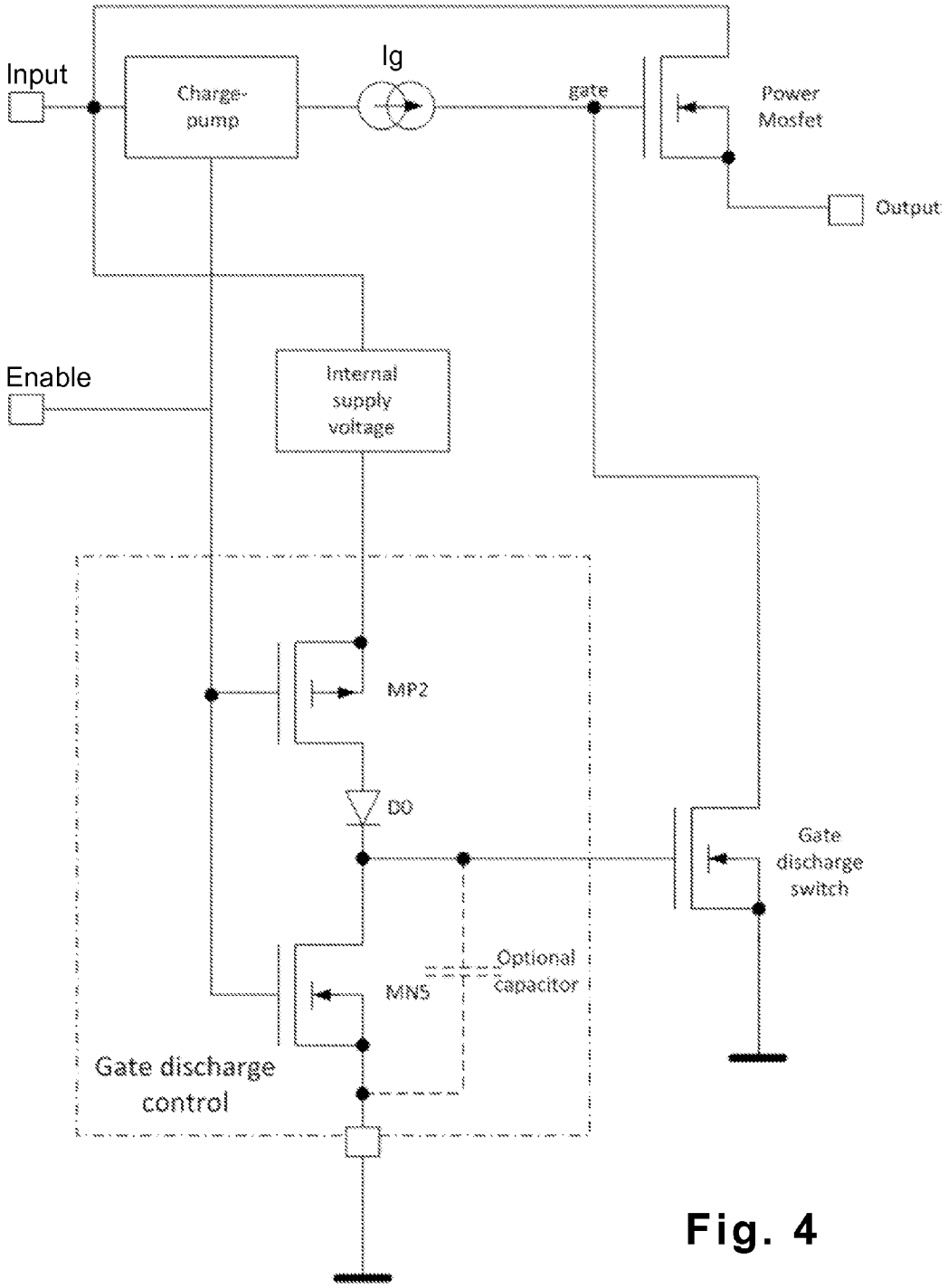
FIG. 4 shows an illustrative integrated power switch with an alternative power-down discharger circuit.

As explained in the background, the use of depletion-mode MOSFETs may not be possible with certain preferred semiconductor process flows. Accordingly, FIG. 4 shows an alternative integrated power switch configuration that does not require a depletion-mode MOSFET. Rather, a normal (enhancement mode) n-channel MOSFET operates as a gate discharge switch, which is driven by an alternative power-down discharger circuit (gate discharge control). This alternative power-down discharger circuit could also be integrated into the EN logic of FIG. 1A and used to control the existing powered-discharge FET M1 after the supply power is lost. In the illustrated embodiment, two complementary MOSFETs (MP2 and MN5) are configured as an inverter to drive the discharge terminal (and hence the gate voltage of discharge FET M1) inversely to the enable pin signal. When the enable signal is asserted, NMOS MN5 drives the discharge terminal voltage low, forcing the gate discharge switch (or discharge FET M1 of FIG. 1A) to a nonconducting state.

Conversely, when the enable signal is de-asserted, the PMOS MP2 drives the discharge terminal voltage high, placing the gate discharge switch (or M1 of FIG. 1A) in a conductive state that discharges the residual charge. The inverter is powered from an internal supply voltage, which is a filtered and optionally regulated voltage on an internal capacitance. As such, the internal supply voltage remains available for a short time after the loss of power to the input pin, ensuring that the enable signal falls before the voltage from the internal power supply.

The circuit further includes a diode (or a FET configured as a diode) between PMOS MP2 and the discharge terminal to prevent the charge on the gate of the discharge switch from draining away via the PMOS when the supply voltage is lost. To increase the duration of the post-power loss assertion, the power-down discharger circuit optionally includes an additional capacitance between the discharge terminal and the ground pin. The additional capacitance gets charged via PMOS MP2 and the diode as the enable signal falls, and charge provides sufficient power to hold the discharge transistor in a conductive state for an extended time. If the gate of discharge transistor has sufficient capacitance in view of the current leakage from the gate, an additional capacitor is unnecessary.

To reduce the buffering requirements of the internal supply voltage, some embodiments of the FIG. 4 power-down discharger may provide transistors MN5 and MP2 with higher threshold voltages than discharge FET, so that when the internal supply voltage falls with the enable signal, the inverter switches, driving the discharge terminal with sufficient voltage to charge the discharge transistor's gate and the additional capacitor for driving the discharge transistor into a conducting state.

In the embodiments of both FIGS. 2 and 4, the power-down dischargers provide energy storage for driving a discharge FET after loss of the supply power, thereby actively discharging any residual charge from the selected capacitors or gates. Both embodiments occupy very little die area. (Estimated die area for discharger circuit with ability to discharge 100 nF capacitor is 75 μm×45 μm—the main areal requirement being attributable to the power storage capacitor, which should be sized to account for parasitic gate capacitances.) The embodiment of FIG. 2C is expected to work with input voltages as low as 1.8 V.

Figure 5:
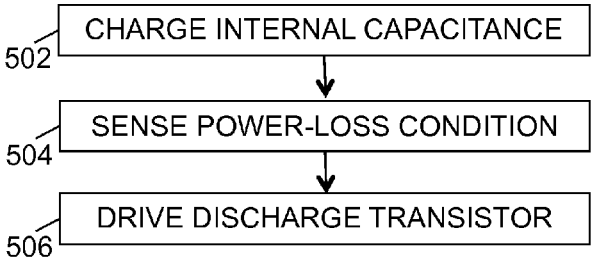
FIG. 5 shows an illustrative active discharging method.

To summarize the illustrative method disclosed in connection with the illustrative circuits above, FIG. 5 provides a flowchart. The method begins with block 502, with the charging of an internal capacitance during the normal operation of the integrated circuit. The internal capacitance may be that used for providing a filtered and conditioned internal supply voltage, or it may be specific to the power discharger itself. In block 504, the power discharger senses a condition indicative of power supply voltage loss, which could illustratively be the voltage on the supply voltage pin falling below a preset threshold, or could be the de-assertion of the enable pin signal. In block 506, the power discharger responsively drives the discharge transistor into a conducting state, relying on energy from the internal capacitance to do so. To prevent the energy from being drained away by the power loss, a diode may be employed somewhere in the circuit between the supply voltage pin and the gate of the discharge transistor. The internal capacitance may be re-sized or supplemented with additional capacitance to ensure that the discharge transistor remains in the conducting state for a sufficient time to fully discharge the capacitor or gate.

The disclosed invention embodiments enable an integrated circuit to handle discharging of any internal or external capacitor, whether in the form of a parasitic capacitance or a discrete circuit element, in case of power supply failure. This ability sets proper conditions prior to any upcoming power supply recovery. The embodiments can be applied to any integrated circuit where residual capacitor voltages could otherwise pose difficulties. It applies to both internal and external capacitances. It doesn't consume any power, as it requires no bias currents.

For explanatory purposes, the foregoing embodiments omit complicating factors such as parasitic impedances, current-limiting resistors, level-shifters, line clamps, etc., which may be present but do not meaningfully impact the operation of the disclosed circuits. These and numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A low dropout (LDO) regulator that comprises:
- an output transistor that couples a DC input voltage pin to a DC output voltage pin;
- an operational amplifier that drives the output transistor in response to a difference between a feedback signal and a reference voltage from a capacitor;
- a soft-start circuit that ramps the reference voltage from an initial voltage;
- a discharge transistor that discharges the capacitor when driven to a conducting state; and
- a power-down discharger that includes:
  - an internal capacitance;
  - a diode, or transistor configured as a diode, connecting the DC input voltage pin to the internal capacitance to charge the internal capacitance;
  - a sense transistor connecting the internal capacitance to a gate of the discharge transistor to drive the discharge transistor to the conducting state when a voltage on the DC input voltage pin drops below a threshold.

2. The low dropout (LDO) regulator of claim 1, wherein the discharge transistor is an n-channel metal-oxide-semiconductor field-effect transistor (NMOS), and the sense transistor is a p-channel metal-oxide-semiconductor field-effect transistor (PMOS) having a gate connected to the DC input voltage pin.

3. An integrated power switch that comprises:
- an output transistor that couples a power supply voltage on a DC input voltage pin to a DC output voltage pin;
- a high-impedance source that drives a gate of the output transistor;
- a discharge transistor that discharges the gate of the output transistor when driven to a conducting state; and
- a power-down discharger that includes:
  - a sense transistor having a gate that receives an enable signal;
  - a diode, or transistor configured as a diode, connecting the sense transistor to a gate of the discharge transistor to drive the discharge transistor to the conducting state when the enable signal is de-asserted.

4. The integrated power switch of claim 3, wherein the power-down discharger further includes an internal capacitance connected to the gate of the discharge transistor.

5. The integrated power switch of claim 3, wherein the discharge transistor is an n-channel metal-oxide-semiconductor field-effect transistor (NMOS), and the sense transistor is a p-channel metal-oxide-semiconductor field-effect transistor (PMOS).

* * * * *